US010152918B2

(12) United States Patent
Tseng

(10) Patent No.: US 10,152,918 B2
(45) Date of Patent: Dec. 11, 2018

(54) SHUTDOWN CONTROLLING METHOD, SHUTDOWN CONTROLLING CIRCUIT, DRIVING CIRCUIT AND AMOLED DISPLAY DEVICE

(71) Applicant: BOE TECHNOLOGY GROUP CO., LTD., Beijing (CN)

(72) Inventor: Szuheng Tseng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 252 days.

(21) Appl. No.: 14/435,985

(22) PCT Filed: Aug. 15, 2014

(86) PCT No.: PCT/CN2014/084533
§ 371 (c)(1),
(2) Date: Apr. 15, 2015

(87) PCT Pub. No.: WO2015/135288
PCT Pub. Date: Sep. 17, 2015

(65) Prior Publication Data

US 2016/0275859 A1 Sep. 22, 2016

(30) Foreign Application Priority Data

Mar. 11, 2014 (CN) ..... 2014 1 0088098

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0842* (2013.01);
(Continued)

(58) Field of Classification Search
CPC ..... G09G 3/3233; G09G 3/3266; G09G 2320/0257; G09G 2300/0426; G09G 2330/027
See application file for complete search history.

(56) References Cited

U.S. PATENT DOCUMENTS

2005/0231501 A1 10/2005 Nitawaki
2014/0132174 A1* 5/2014 Smith ..... G09G 3/3233 315/224
2015/0206477 A1* 7/2015 Xu ..... G09G 3/3233 345/206

FOREIGN PATENT DOCUMENTS

CN 100382129 C 4/2008
CN 101320171 A 12/2008
(Continued)

OTHER PUBLICATIONS

Office Action in Chinese Patent Application No. 201410088098.0, dated Apr. 25, 2016.
(Continued)

*Primary Examiner* — Robert Michaud
(74) *Attorney, Agent, or Firm* — Brooks Kushman P.C.

(57) ABSTRACT

The AMOLED display device includes a light-emitting source and a display screen provided with a plurality of subpixels. Each subpixel includes a driving transistor, and a capacitor arranged between a gate electrode and a source electrode of the driving transistor and connected to a signal line via a switching element. The shutdown controlling method includes: determining whether or not a shutdown signal has been detected; performing a first control operation when the shutdown signal has been detected, so as to control a voltage on the signal line to be in a first voltage state; and performing a second control operation when the shutdown signal has been detected, so as to control the switching element to be in an on state, thereby to enable the capacitor
(Continued)

to be discharged completely toward the signal line in the first voltage state via the switching element.

3 Claims, 2 Drawing Sheets

(52) U.S. Cl.
CPC ..... *G09G 2320/0257* (2013.01); *G09G 2330/027* (2013.01)

(56) References Cited

FOREIGN PATENT DOCUMENTS

| | | | |
|---|---|---|---|
| CN | 102867491 | A | 1/2013 |
| CN | 103400546 | A | 11/2013 |
| CN | 203366703 | U | 12/2013 |
| CN | 203433775 | U | 2/2014 |
| CN | 103943064 | A | 7/2014 |
| JP | 2012-014182 | A | 1/2012 |
| TW | 200834525 | A | 8/2008 |

OTHER PUBLICATIONS

Office Action in Chinese Patent Application No. 201410088098.0, dated Sep. 1, 2015.
International Search Report and Written Opinion in PCT International Application No. PCT/CN2014/084533, dated Dec. 22, 2014.
Notification of Reexamination Chinese Application No. 201410088098.0, dated May 15, 2017, 8 Pages.

* cited by examiner

SHUTDOWN CONTROLLING METHOD, SHUTDOWN CONTROLLING CIRCUIT, DRIVING CIRCUIT AND AMOLED DISPLAY DEVICE

CROSS-REFERENCE TO RELATED APPLICATIONS

The present application is the U.S. National Phase of International Patent Application No. PCT/CN2014/084533, filed Aug. 15, 2014 and claims a priority of the Chinese patent application No. 201410088098.0 filed on Mar. 11, 2014, which is incorporated herein by reference in its entirety.

TECHNICAL FIELD

The present disclosure relates to the field of display technology, in particular to a shutdown controlling method, a shutdown controlling circuit, a driving circuit and an AMOLED (active matrix/organic light-emitting diode) display device.

BACKGROUND

In an existing IGZO (indium gallium zinc oxide)-based AMOLED display device, when a TFT (thin film transistor) of a pixel unit driving circuit is subjected to a gate stress, a threshold shift will occur, which results in such a visual effect as image retention.

To be specific, as shown in FIG. 1, a 2T1C pixel unit driving circuit is taken as an example. Once a power source is turned off, scanning voltages Vscan1 and Vscan2 applied to a gate electrode of a first data input transistor T1 and a gate electrode of a second data input transistor T2 are decreased to 0V. The reason for the decrease is that the scanning voltage is usually generated by a charge pump and a capacitance for voltage stabilization is relatively small. In a normal case, data voltages Vdata stored in a first storage capacitor C1 and a second storage capacitor C2 are decreased rapidly to 0V, so there is no risk of gate stress at this time. However, in fact, the gate stress has been applied onto T1 and T2, and the threshold voltages of T1 and T2 have been increased. At this time, due to the voltage, i.e., 0V, applied to the gate electrodes of T1 and T2, T1 and T2 are in an off state, so charges are stored in C1 and C2 for a long period of time and cannot be released, even if no power is applied to the entire system. As a result, the gate stress is applied onto gate electrodes of a first driving transistor TFT1 and a second driving transistor TFT2 for a long period of time. When the display device is turn on again, due to the long-term gate stress applied onto the driving transistors after the previous shutdown, a user will find that there is the image retention on an AMOLED display screen for the last image before the previous shutdown. In FIG. 1, OLED represents an organic light-emitting diode, and ELVDD and ELVSS represent a high-level output end and a low-level output end of the driving power source, respectively.

SUMMARY

A main object of the present disclosure is to provide a shutdown controlling method, a shutdown controlling circuit, a driving circuit and an AMOLED display device, so as to prevent the occurrence of image retention caused when a gate stress is applied to a driving transistor of the AMOLED display device for a long period of time after the shutdown.

In one aspect, the present disclosure provides in one embodiment a shutdown controlling method for use in an AMOLED display device. The AMOLED display device includes a light-emitting source and a display screen provided with a plurality of subpixels. Each subpixel includes a driving transistor, and a capacitor arranged between a gate electrode and a source electrode of the driving transistor and connected to a signal line via a switching element. The shutdown controlling method includes:

a determination step of determining whether or not a shutdown signal has been detected;

a voltage controlling step of performing a first control operation when it is determined that the shutdown signal has been detected, so as to control a voltage on the signal line to be in a first voltage state; and a discharge controlling step of performing a second control operation when it is determined that the shutdown signal has been detected, so as to control the switching element to be in an on state, thereby to enable the capacitor to be discharged completely toward the signal line in the first voltage state via the switching element.

During the implementation, subsequent to the determination step and prior to the voltage controlling step, the method further includes:

a light-emitting source cutoff step of cutting off a power source of the light-emitting source when it is determined that the shutdown signal has been detected.

During the implementation, subsequent to the determination step and prior to the light-emitting source cutoff step, the method further includes:

a black image generation step of sending a black image to the display screen when it is determined that the shutdown signal has been detected.

During the implementation, the switching element is a data input transistor, the signal line is a data line, a gate electrode of the data input transistor is connected to a scanning line, a data voltage is applied by a data driving circuit to the data line, and a scanning voltage is applied by a scan driving circuit to the scanning line. The first control operation includes cutting off a power source of the data driving circuit. The second control operation includes controlling the scanning voltage applied by the scan driving circuit to the scanning line to be in a second voltage state, so as to enable the data input transistor to be in an on state; and cutting off a power source of the scan driving circuit after the capacitor is discharged completely.

During the implementation, the switching element is a data input transistor, the signal line is a data line, a gate electrode of the data input transistor is connected to a scanning line, a data voltage is applied by a data driving circuit to the data line, and a scanning voltage is applied by a scan driving circuit to the scanning line. The first control operation includes cutting off a power source of the data driving circuit. The second control operation includes controlling the scan driving circuit to continuously apply the scanning voltage to the scanning line, so as to enable the data input transistor to be in an on state; and cutting off a power source of the scan driving circuit after at least one scanning period.

In another aspect, the present disclosure provides in one embodiment a shutdown controlling circuit for use in an AMOLED display device. The AMOLED display device includes a light-emitting source and a display screen provided with a plurality of subpixels. Each subpixel includes a driving transistor, and a capacitor arranged between a gate electrode and a source electrode of the driving transistor and connected to a signal line via a switching element. The shutdown controlling circuit includes:

a determination module configured to determine whether or not a shutdown signal has been detected;

a voltage controlling module configured to perform a first control operation when the determination module determines that the shutdown signal has been detected, so as to control a voltage on the signal line to be in a first voltage state; and a discharge controlling module configured to perform a second control operation when the determination module determines that the shutdown signal has been detected, so as to control the switching element to be in an on state, thereby to enable the capacitor to be discharged completely toward the signal line in the first voltage state via the switching element.

During the implementation, the shutdown controlling circuit further includes:

a light-emitting source cutoff module configured to cut off a power source of the light-emitting source when the determination module determines that the shutdown signal has been detected.

During the implementation, the shutdown controlling circuit further includes a black image generation circuit configured to provide a black image signal to the data line when the determination module determines that the shutdown signal has been detected, so as to send a black image to the display screen.

During the implementation, the switching element is a data input transistor, the signal line is a data line, a gate electrode of the data input transistor is connected to a scanning line, a data voltage is applied by a data driving circuit to the data line, and a scanning voltage is applied by a scan driving circuit to the scanning line. The voltage controlling module is configured to cut off a power source of the data driving circuit when the determination module determines that the shutdown signal has been detected. The discharge controlling module is configured to control the scanning voltage applied by the scan driving circuit to the scanning line to be in a second voltage state when the determination module determines that the shutdown signal has been detected, so as to enable the data input transistor to be in an on state, thereby to enable the capacitor to be discharged toward the data line via the switching element; and configured to cut off a power source of the scan driving circuit after the capacitor is discharged completely.

During the implementation, the switching element is a data input transistor, the signal line is a data line, a gate electrode of the data input transistor is connected to a scanning line, a data voltage is applied by a data driving circuit to the data line, and a scanning voltage is applied by a scan driving circuit to the scanning line. The voltage controlling circuit is configured to cut off a power source of the data driving circuit when the determination module determines that the shutdown signal has been detected. The discharge controlling module is configured to control the scan driving circuit to continuously apply the scanning voltage to the scanning line when the determination module determines that the shutdown signal has been detected, so as to enable the data input transistor to be in an on state; and configured to cut off a power source of the scan driving circuit after at least one scanning period.

In yet another aspect, the present disclosure provides in one embodiment a driving circuit for use in an AMOLED display device, which includes the above-mentioned shutdown controlling circuit.

In still yet another aspect, the present disclosure provides in one embodiment an AMOLED display device including the above-mentioned driving circuit.

According to the shutdown controlling method, the shutdown controlling circuit, the driving circuit and the AMOLED display device in the embodiments of the present disclosure, the capacitor between the gate electrode and the source electrode of the driving transistor is completely discharged when it is determined that the shutdown signal has been detected. As a result, as compared with the related art, no matter when the other power sources are cut off, it is still able to prevent the occurrence of the image retention due to the gate stress applied to the driving transistors when the display device is turned on again.

DETAILED DESCRIPTION

The present disclosure will be described hereinafter in a clear and complete manner in conjunction with the drawings and embodiments. Obviously, the following embodiments are merely a part of, rather than all of, the embodiments of the present disclosure. Based on these embodiments, a person skilled in the art may obtain the other embodiments without any creative effort, which also fall within the scope of the present disclosure.

All transistors adopted in the embodiments of the present disclosure may be TFTs, or field effect transistors (FETs), or any other elements with the same characteristics. In the embodiments of the present disclosure, in order to differentiate two electrodes of the transistor apart from a gate electrode, one is called as a source electrode and the other is called as a drain electrode. In addition, depending on the characteristics, the transistors may include N-type transistors and P-type transistors. For a driving circuit in the embodiments of the present disclosure, N-type transistors are taken as an example. Of course, P-type transistors may be used, which also fall within the scope of the present disclosure.

According to a shutdown controlling method, a shutdown controlling circuit, a driving circuit and an AMOLED display device in the embodiments of the present disclosure, a capacitor between a gate electrode and a source electrode of a driving transistor is completely discharged when it is determined that a shutdown signal has been detected. As a result, no matter when the other power sources are cut off, it is still able to prevent the occurrence of image retention due to a gate stress applied to the driving transistors when the display device is turned on again.

The present disclosure provides in the first embodiment a shutdown controlling method for use in an AMOLED display device. The AMOLED display device includes a light-emitting source and a display screen provided with a plurality of subpixels. Each subpixel includes a driving transistor, and a capacitor arranged between a gate electrode and a source electrode of the driving transistor and connected to a signal line via a switching element.

Figure 1:
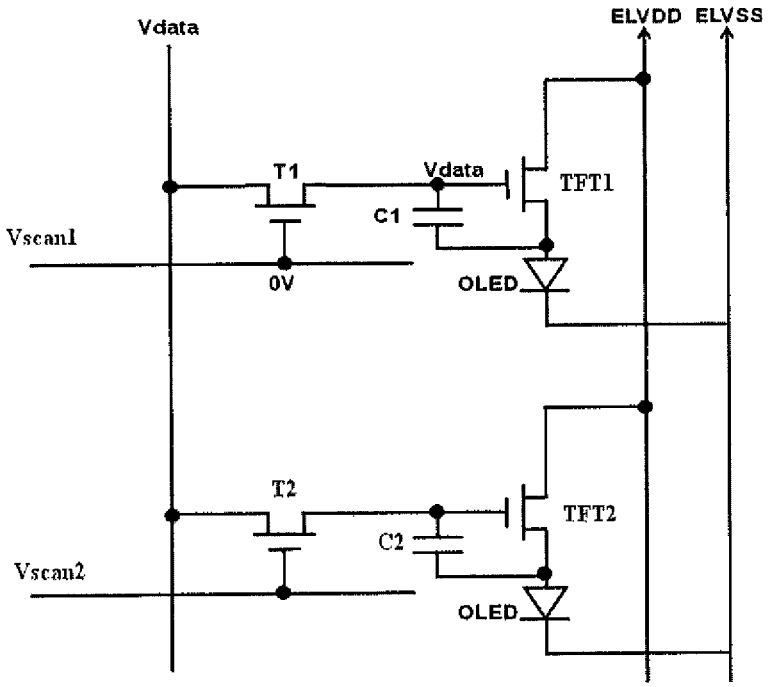
FIG. 1 is a schematic view showing an existing 2T1C pixel unit driving circuit.
Figure 2:
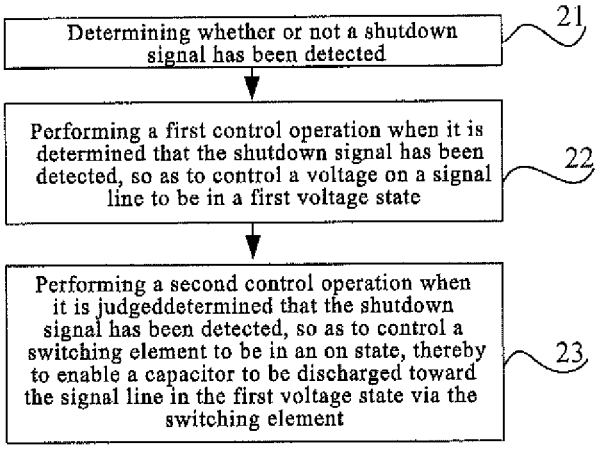
FIG. 2 is a flow chart of a shutdown controlling method according to the first embodiment of the present disclosure.

As shown in FIG. 2, the shutdown controlling method includes:

a determination step S21 of determining whether or not a shutdown signal has been detected;

a voltage controlling step S22 of performing a first control operation when it is determined that the shutdown signal has been detected, so as to control a voltage on the signal line to be in a first voltage state; and a discharge controlling step S23 of performing a second control operation when it is determined that the shutdown signal has been detected, so as to control the switching element to be in an on state, thereby to enable the capacitor to be discharged completely toward the signal line in the first voltage state via the switching element According to the shutdown controlling method in this embodiment, when it is determined that the shutdown signal has been detected, the signal line connected to the capacitor, which is included in each subpixel and arranged between the gate electrode and the source electrode of the driving transistor, via the switching element is controlled to be in the first voltage state, which may be a low level state, and the switching element is controlled to be in the on state. As a result, it is able to cause the capacitor to be completely discharged toward the signal line via the switching element, thereby to prevent the occurrence of image retention due to a gate stress applied to the driving transistor after the display device is turned on again.

In the shutdown controlling method of this embodiment, the switching element connected to the capacitor between the gate electrode and the source electrode of the driving transistor may be a data input transistor known in the art, or any other transistors. The signal line connected to the capacitor via the switching element may be a data line known in the art, or any other signal line, as long as it can turn on the switching element when the shutdown signal has been detected and the signal line is in the first voltage state where it can receive the charges from the capacitor.

During the implementation, subsequent to the determination step and prior to the voltage controlling step, the method further includes a light-emitting source cutoff step of cutting off a power source of the light-emitting source.

During the implementation, subsequent to the determination step and prior to the light-emitting source cutoff step, the method further includes sending a black image to the display screen.

Alternatively, the black image may be sent to the display screen and the power source of the light-emitting source may be cut off when the shutdown signal has been detected. In this way, it is able to show the black image on the display screen when the display device is turned off, thereby to prevent a user from viewing an undesired image generated due to a shutdown sequence.

Figure 3:
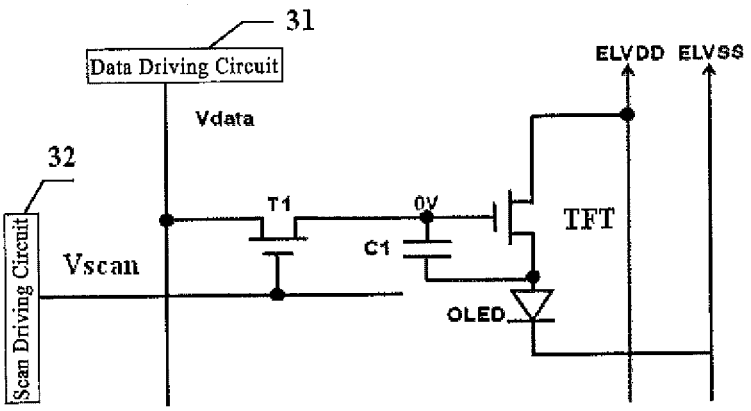
FIG. 3 is a schematic view showing a subpixel included in an AMOLED display device using the shutdown controlling method according to the second and third embodiments of the present disclosure.

The present disclosure provides in the second embodiment the shutdown controlling method for use in the AMOLED display device. The AMOLED display device includes a light-emitting source and a display screen provided with a plurality of subpixels. As shown in FIG. 3, each subpixel includes a driving transistor TFT, and a capacitor C1 arranged between a gate electrode and a source electrode of the driving transistor TFT and connected to a data line via a data input transistor T1. A gate electrode of the data input transistor T1 is connected to a scanning line. A data voltage Vdata is applied by a data driving circuit 31 to the data line, and a scanning voltage Vscan is applied by a scan driving circuit 32 to the scanning line.

The shutdown controlling method in the second embodiment of the present disclosure includes steps of:

determining whether or not a shutdown signal has been detected;

when it is determined that the shutdown signal has been detected, cutting off a power source of the data driving circuit 31 so that the data voltage applied to the data line is 0V; and controlling the scanning voltage Vscan applied by the scan driving circuit 32 to the scanning line to be in a second voltage stage so as to enable the data input transistor T1 to be in an on state and enable the capacitor C1 to be completely discharged toward the data line via the data input transistor T1; and cutting off a power source of the scan driving circuit 32 after the capacitor C1 is completely discharged.

In FIG. 3, OLED represents an organic light-emitting diode, and ELVDD and ELVSS represent a high-level output end and a low-level output end of the driving power source, respectively.

In FIG. 3, the data input transistor T1 is an N-type TFT, and the second voltage state of the scanning voltage Vscan applied to the data input transistor T1 is at a high level. In the other embodiments of the present disclosure, when the data input transistor T1 is a P-type TFT, the second voltage state of the scanning voltage Vscan applied to the data input transistor T1 is at a low level.

In the second embodiment, when it is determined that the shutdown signal has been detected, it is required to maintain the power source of the scan driving circuit 32 and control the scanning voltage Vscan output from the scan driving circuit 32 to be in the second voltage state. The power source of the scan driving circuit 32 is cut off only when the capacitor C1 has been completely discharged. According to the shutdown controlling method in this embodiment, the known data input transistor T1 and data line are used to enable the capacitor C1 to be completely discharged, and as a result, it is able to prevent the occurrence of image retention and save energy.

The present disclosure provides in the third embodiment the shutdown controlling method for use in an AMOLED display device. The AMOLED display device includes a light-emitting source and a display screen provided with a plurality of subpixels. As shown in FIG. 3, each subpixel includes a driving transistor TFT, and a capacitor C1 arranged between a gate electrode and a source electrode of the driving transistor TFT and connected to a data line via a data input transistor T1. A gate electrode of the data input transistor T1 is connected to a scanning line. A data voltage Vdata is applied by a data driving circuit 31 to the data line, and a scanning voltage Vscan is applied by a scan driving circuit 32 to the scanning line.

The shutdown controlling method in the third embodiment includes steps of:

determining whether or not a shutdown signal has been detected;

when it is determined that the shutdown signal has been detected, cutting off a power source of the data driving circuit 31 so that the data voltage Vdata applied to the data line is 0V; and controlling the scan driving circuit 32 to continuously apply the scanning voltage Vscan to the scanning line so as to enable the data input transistor T1 to be in an on state, and cutting off a power source of the scan driving circuit 32 after at least one scanning period so as to enable the capacitor C1 to be completely discharged toward the data line via the data input transistor T1.

According to the shutdown controlling method in the third embodiment of the present disclosure, the known data input transistor T1 and data line are used to enable the capacitor C1 to be completely discharged, so as to prevent the occurrence of image retention and save energy. In addition, when it is determined that the shutdown signal has been detected, it is required to maintain the power source of the scan driving circuit 32. However, as compared with the shutdown controlling method in the second embodiment, the capacitor C1 may be discharged in this embodiment without any need to change the scanning voltage Vscan output from the scan driving circuit 32. In fact, in this embodiment, the scanning voltage Vscan applied by the scan driving circuit 32 to a plurality of rows of scanning lines is effective row by row in one scanning period, and it is used to sequentially enable the data input transistor T1 controlled by each row of the scanning lines to be in an on state. Hence, in order to ensure that the capacitors included in the subpixels of the display screen are completely discharged, it is required to cut off the power source of the scan driving circuit 32 after at least one scanning period.

During the implementation, in order to prevent a sudden poweroff, a standby power source must be provided so as to ensure the implementation of the shutdown controlling method. When it is determined that the shutdown signal has been detected, it is required to start the standby power source at first.

In general, when the shutdown controlling method in the embodiments of the present disclosure is adopted and the AMOLED display device is shut down, as its shutdown sequence, the light-emitting source is turned off, then the capacitor between the gate electrode and the source electrode of the driving transistor is completely discharged (i.e., the power source of the data driving circuit and the power source of the scan driving circuit are turned off sequentially), and then a power source of a circuit for generating a digital voltage and a digital signal in the AMOLED display device is turned off.

Figure 4:
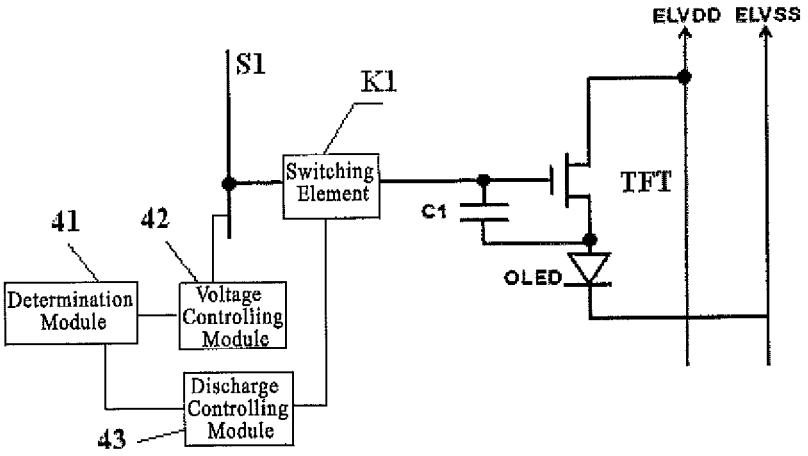
FIG. 4 is a schematic view showing a shutdown controlling circuit according to an embodiment of the present disclosure.

The present disclosure provides in one embodiment a shutdown controlling circuit for use in an AMOLED display device. The AMOLED display device includes a light-emitting source and a display screen provided with a plurality of subpixels. As shown in FIG. 4, each subpixel includes a driving transistor TFT, and a capacitor C1 arranged between a gate electrode and a source electrode of the driving transistor TFT and connected to a signal line S1 via a switching element K1. The shutdown controlling circuit includes:

a determination module 41 configured to determine whether or not a shutdown signal has been detected;

a voltage controlling module 42 configured to perform a first control operation when the determination module 41 determines that the shutdown signal has been detected, so as to control a voltage on the signal line S1 to be in a first voltage state; and a discharge controlling module 43 configured to perform a second control operation when the determination module 41 determines that the shutdown signal has been detected, so as to control the switching element K1 to be in an on state, thereby to enable the capacitor C1 to be discharged completely toward the signal line S1 in the first voltage state via the switching element K1.

According to the shutdown controlling circuit in the embodiment of the present disclosure, when it is determined that the shutdown signal has been detected, the signal line S1 connected to the capacitor C1 via the switching element K1 is controlled to be in the first voltage state which may be a low level state, and the switching element K1 is controlled to be in an on state. As a result, it is able to cause the capacitor C1 to be completely discharged toward the signal line S1 via the switching element K1, thereby to prevent the occurrence of image retention due to a gate stress applied to the driving transistor TFT when the display device is turned on again.

In the shutdown controlling circuit of this embodiment, the switching element K1 connected to the capacitor C1 between the gate electrode and the source electrode of the driving transistor TFT may be a data input transistor known in the art, or any other transistors. The signal line S1 connected to the capacitor C1 via the switching element K1 may be a data line known in the art, or any other signal line, as long as it can turn on the switching element K1 when the shutdown signal has been detected and the signal line S1 is in the first voltage state where it can receive the charges from the capacitor C1.

Alternatively, the shutdown controlling circuit further includes a light-emitting source cutoff module configured to cut off a power source of the light-emitting source when the determination module determines that the shutdown signal has been detected.

Alternatively, the shutdown controlling circuit further includes a black image generation circuit configured to provide a black image signal to the data line when the determination module determines that the shutdown signal has been detected, so as to send a black image to the display screen.

Alternatively, the switching element is a data input transistor, the signal line is a data line, a gate electrode of the data input transistor is connected to a scanning line, a data voltage is applied by a data driving circuit to the data line, and a scanning voltage is applied by a scan driving circuit to the scanning line. The voltage controlling module is configured to cut off a power source of the data driving circuit when the determination module determines that the shutdown signal has been detected. The discharge controlling module is configured to control the scanning voltage applied by the scan driving circuit to the scanning line to be in a second voltage state when the determination module determines that the shutdown signal has been detected, so as to enable the data input transistor to be in an on state, thereby to enable the capacitor to be discharged toward the data line via the switching element; and configured to cut off a power source of the scan driving circuit after the capacitor is discharged completely.

In the shutdown controlling circuit of this embodiment, when it is determined that the shutdown signal has been detected, it is required to maintain the power source of the scan driving circuit and control the scanning voltage output from the scan driving circuit to be in the second voltage state. The power source of the scan driving circuit is cut off only when the capacitor has been completely discharged. According to the shutdown controlling method in this embodiment, the known data input transistor and data line are used to enable the capacitor to be completely discharged, and as a result, it is able to prevent the occurrence of image retention and save energy.

Alternatively, the switching element is a data input transistor, the signal line is a data line, a gate electrode of the data input transistor is connected to a scanning line, a data voltage is applied by a data driving circuit to the data line, and a scanning voltage is applied by a scan driving circuit to the scanning line. The voltage controlling circuit is configured to cut off a power source of the data driving circuit when the determination module determines that the shutdown signal has been detected. The discharge controlling module is configured to control the scan driving circuit to continuously apply the scanning voltage to the scanning line when the determination module determines that the shutdown signal has been detected, so as to enable the data input transistor to be in an on state; and configured to cut off a power source of the scan driving circuit after at least one scanning period.

According to the shutdown controlling circuit in this embodiment of the present disclosure, the known data input transistor and data line are used to enable the capacitor to be completely discharged, so as to prevent the occurrence of image retention and save energy. In addition, when it is determined that the shutdown signal has been detected, it is required to maintain the power source of the scan driving circuit. The capacitor may be discharged completely without any need to change the scanning voltage output from the scan driving circuit. In fact, in this embodiment, the scanning voltage applied by the scan driving circuit to a plurality of rows of scanning lines is effective row by row in one scanning period, and it is used to sequentially enable the data input transistor controlled by each row of the scanning lines to be in an on state. Hence, in order to ensure that the capacitors included in the subpixels of the display screen are completely discharged, it is required to cut off the power source of the scan driving circuit after at least one scanning period.

The present disclosure further provides in one embodiment a driving circuit for use in an AMOLED display device, which includes the above-mentioned shutdown controlling circuit.

The present disclosure further provides in one embodiment an AMOLED display device including the above-mentioned driving circuit. Alternatively, the AMOLED display device may be an IGZO AMOLED display device.

The above embodiments are for illustrative purposes only, but shall not be used to limit the present disclosure. It should be appreciated that, a person skilled in the art may make further modifications and improvements without departing from the spirit of the present disclosure, and these modifications and improvements shall also fall within the scope of the present disclosure.

What is claimed is:

1. A shutdown controlling method, for use in an AMOLED (active matrix/organic light-emitting diode) display device, the AMOLED display device comprising a light-emitting source, a plurality of data lines, a plurality of scanning lines and a display screen provided with a plurality of subpixels, each subpixel comprising a driving transistor and a capacitor, the capacitor being directly connected to a gate electrode and a source electrode of the driving transistor and connected to one of the plurality of data lines via a data input transistor, a gate electrode of the data input transistor is connected to one of the plurality of scanning lines, a data voltage is applied by a data driving circuit to the data line, and a scanning voltage is applied by a scan driving circuit to the scanning line, the shutdown controlling method comprising:

a determination step of determining whether or not a shutdown signal has been detected;

a voltage controlling step of cutting off a power source of the data driving circuit when it is determined that the shutdown signal has been detected, so as to control a voltage on the data line to be in a first voltage state; and a discharge controlling step of continuously providing scanning voltages to the plurality of scanning lines without changing the scanning voltages output from the scan driving circuit, progressively scanning to enable the plurality of scanning lines row by row in one scanning period, and sequentially enabling a plurality of data input transistors controlled by each row of scanning line to be in an on state, the plurality of scanning lines being continuously arranged and adjacent to each other, and cutting off the power source of the scan driving circuit after the one scanning period, when it is determined that the shutdown signal has been detected, thereby to enable the capacitor to be discharged completely toward the data line in the first voltage state via the data input transistor.

2. The shutdown controlling method according to claim 1, further comprising, subsequent to the determination step and prior to the voltage controlling step, a light-emitting source cutoff step of cutting off a power source of the light-emitting source when it is determined that the shutdown signal has been detected.

3. The shutdown controlling method according to claim 2, further comprising, subsequent to the determination step and prior to the light-emitting source cutoff step, a black image generation step of sending a black image to the display screen when it is determined that the shutdown signal has been detected.

* * * * *